United States Patent [19]

Liljedahl

[11] 4,077,091

[45] Mar. 7, 1978

[54] STRAP ADJUSTING DEVICE

[75] Inventor: Trygve Liljedahl, Lillehammer, Norway

[73] Assignee: Trygve Liljedahl Skistavfabrikk A/S, Lillehammer, Norway

[21] Appl. No.: 742,285

[22] Filed: Nov. 16, 1976

[30] Foreign Application Priority Data

Nov. 20, 1975 Sweden ..... 7513041

[51] Int. Cl.[2] ..... A44B 11/25; A44B 11/00

[52] U.S. Cl. ..... 24/77 R; 24/198; 24/163 R; 2/322; 280/11.37 H

[58] Field of Search ..... 24/198, 200, 77 R, 201 A, 24/17 A, 163 R, 74 A; 2/322; 280/11.37 H

[56] References Cited

U.S. PATENT DOCUMENTS

| | | | |
|---|---|---|---|
| 323,866 | 8/1885 | Fuechsel | 24/200 |
| 909,399 | 1/1909 | Greenwood | 24/17 A |
| 1,110,534 | 9/1914 | Chamberlain | 24/17 A |
| 2,002,946 | 5/1935 | Jacobs | 24/200 |
| 2,202,644 | 5/1940 | Blossom | 2/322 |
| 2,493,447 | 1/1950 | Delano | 2/322 |
| 3,611,511 | 10/1971 | Grabenkort | 24/201 A |

FOREIGN PATENT DOCUMENTS

| | | | |
|---|---|---|---|
| 817,734 | 4/1952 | Germany | 2/322 |
| 906,561 | 3/1954 | Germany | 24/201 A |

*Primary Examiner*—Bernard A. Gelak
*Attorney, Agent, or Firm*—Brumbaugh, Graves, Donohue & Raymond

[57] ABSTRACT

A strap adjusting device comprising a clasp and two strap parts being passed in opposite directions into the clasp, a first strap part being in non-adjustable relationship with the clasp, and having a tab with greater width than the strap end; and a second strap part being in adjustable relationship with the clasp and being passed over the first strap. The device is especially useful in hand straps for ski poles.

5 Claims, 4 Drawing Figures

STRAP ADJUSTING DEVICE

The present invention is related to a strap adjusting device, in which an adjustable part of a strap and a non-adjustable part of a strap are held together in a clasp or buckle.

The object of the invention is to obtain a strap adjusting device, which may be assembled in a simple manner. A further object is to obtain an adjusting device for ski pole straps which device may be assembled in a simple manner.

It is previously known to assemble two strap parts in a clasp consisting of three rods oriented across the direction of the strap parts and two pieces along the strap parts joining together said rods. Such clasp will hereinafter be referred to as a "three rod clasp". In such three rod clasps one strap part has been fixed to one of the perpendicularly oriented rods, usually by the strap part being formed in a loop round the rod and the loop being closed by riveting or glueing of the strap.

Swiss patent specification 523 080 describes an adjusting device, in which two strap parts made of comparatively rigid plastic material are passed in the same direction through a three rod clasp, and in which locking of the strap parts takes place with the aid of across-running ridges. The lastmentioned construction will be a possible choice only in comparatively rigid strap materials, in which the ridges mentioned may be obtained e.g. by injection molding.

According to the present invention a strap adjusting device is obtained in which two strap parts are held together in a three rod clasp, whereby none of the strap parts is fixed to the clasp and whereby across-running ridges on the surface of the strap parts are not necessary. The invention comprises a three rod clasp, a strap part in non-adjustable relationship to the clasp, and a strap part in adjustable relationship to the clasp, whereby said strap parts are passed in opposite directions into the three rod clasp. The invention is characterized in that the strap part in non-adjustable relationship to the clasp is passed over the middle rod of the clasp, and that the leading edge thereof that is passed through the clasp is provided with a tab, the width of which is greater than the inner width of the three rod clasp, and that the strap part in adjustable relationship to the clasp is passed over the other strap part and under the two outer rods of the clasp.

The invention will be more closely described with reference to the enclosed drawings in which.

Figure 1:
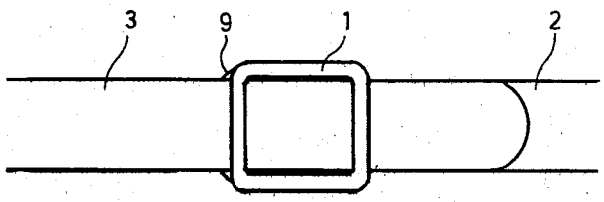
FIG. 1 shows a view from above of a strap adjustng device according to the invention.

In the drawings 1 denotes a clasp of the type herein referred to as a three rod clasp. 2 denotes a strap part in non-adjustable relationship to the clasp 1. A strap part in adjustable relationship to the clasp 1 is denoted with 3. The clasp 1 comprises two outer across-running rods 4, 6, one middle across-running rod 5 and two joining pieces 7, 6. The end of the strap part 2 is provided with a tab 9, integral with said strap part 2, the width (a) of which is greater than the inner width (b) of the clasp 1. On assembling the strap adjusting device the tab 9 is passed through the two openings of the clasp 1 in such manner that the strap part 2 is placed over the middle rod 5. Thereafter the adjustable strap part 3 is introduced from the opposite direction, in such manner that it is placed over the non-adjustable strap part 2 and under the across-running rods 4 and 6. On tension in the strap parts 2 and 3 the tab 4 will be retained in the clasp 1 partly through friction against the different parts of the clasp 1 partly because the space in the openings of the clasp 1 is insufficient for passage of the tab 9 when both strap parts are placed therein. The openings in the clasps have thus dimensions adapted to the width of the strap parts 2 and 3 and to the added thickness thereof. The adjustable strap part 3 is retained mainly by friction against strap part 2 and the parts of the clasp.

On assembling the strap adjusting device the tab 9 has a further function in stopping strap part 2 from sliding out of the clasp 1 on introduction of strap part 3. The assembling operation is thereby much simplified.

Figure 2:
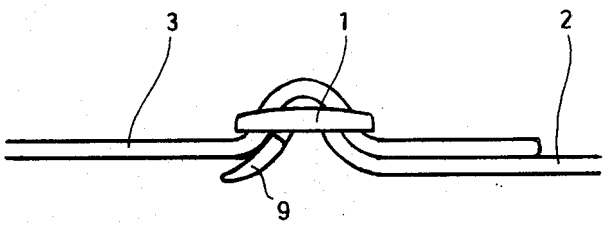
FIG. 2 shows a side view of the device of FIG. 1.
Figure 3:
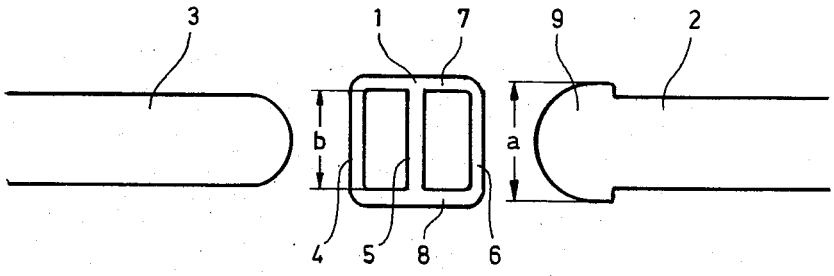
FIG. 3 shows a view from above of the device of FIG. 1 disassembled.

To facilitate the introduction of the tab 9 in the clasp the tab suitably has a bevelled end as seen in FIG. 2.

Figure 4:
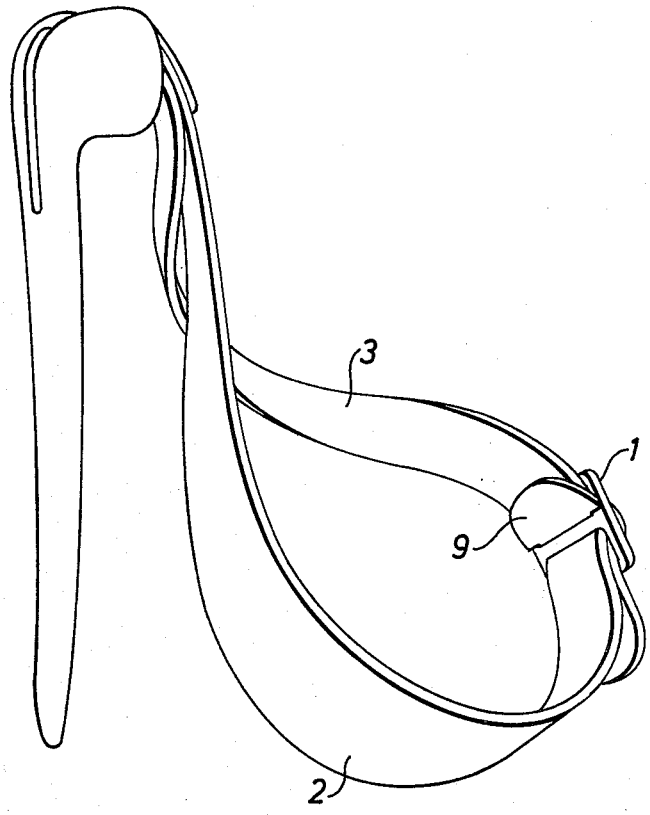
FIG. 4 shows a hand strap for a ski pole comprising a strap adjusting device according to the invention.

The strap adjusting device according to the present invention is primarily intended for use in adjustable hand straps for ski poles. Thereby is obtained a hand strap, which may be adjusted continuously by the skier in a simple manner, and which has a very good tensile strength. As seen in FIG. 4 the strap adjusting device is then located in the strap so as to fall on the outer side of the skier's hand. In a hand strap for a ski pole, having a strap adjusting device according to the invention one strap part may suitably comprise a broadened portion providng improved support for the lower side of the skier's hand.

The strap parts comprised by the strap adjusting device may be made in various materials. In hand straps for ski poles leather material, such as chrome tanned leather, is preferred. Other possible materials are textile or plastic material. The three rod clasp is suitably made of a plastic material, having sufficient elasticity and strength, such as nylon, or a metal.

Obviously, numerous modifications and variations of the above-described preferred embodiment are possible in light of this disclosure. Accordingly, it is expressly to be understood that the invention may be practiced without departing from the scope and spirit of the appended claims wherein the invention is defined.

I claim:

1. A strap adjusting device for an adjustable hand strap on a ski pole, comprising:

a clasp, a first strap part adapted to be fastened at one end to the ski pole and, at the other end, in nonadjustable relationship with the clasp, a second strap part also adapted to be fastened at one end to the ski pole and, at the other end, in adjustable relationship with the clasp, the clasp including one middle rod and two outer rods all oriented across the direction of the strap parts and defining between said rods two openings for the strap parts, and two pieces oriented along the strap parts and joining said rods, said two strap parts being passed in opposite directions into the clasp under the two outer rods and over the middle rod, said first strap part in nonadjustable relationship with the clasp is provided with a tab integral therewith, the width of which tab is greater than the width of the openings of the clasp, the openings having dimensions adapted to the width and thickness of the strap parts.

2. A strap adjusting device according to claim 1 characterized in that the tab has a bevelled leading edge.

3. A combination for adjustably joining two free strap end portions, comprising:

a three rod clasp having two parallel outer bars and a center bar parallel to said outer bars;

one of said strap end portions having an integral terminal tab that is enlarged in width symmetrically on both sides of the longitudinal centerline of the strap, said enlarged terminal portion being wider than said bars are long;

said one end portion passing beneath said two outer bars and over said center bar;

the other of said strap end portions passing between said enlarged terminal tab and one of said outer bars of said clasp, between the bight portion of said first strap end portion and the other outer bar of the clasp, and above the center bar and said first strap end portion;

whereby said two free strap end portions may be easily and quickly assembled together with three rod clasp to adjustably join said free strap end portions together without fixing either of said free ends to said clasp.

4. The combination defined in claim 3, wherein:

both of said strap ends are smooth on both top and bottom surfaces.

5. The combination defined in claim 3, wherein:

said other strap end portion and said one strap end portion forward of said tab both have a width approximately equal to the length of said bars; and said tab has a beveled leading edge and a trailing edge formed as a pair of square lateral shoulders.

* * * * *